US009537235B2

(12) United States Patent
Tsang et al.

(10) Patent No.: US 9,537,235 B2
(45) Date of Patent: Jan. 3, 2017

(54) CONFIGURABLE GUIDE HARDWARE FOR CONNECTOR SYSTEMS

(71) Applicant: Tyco Electronics Corporation, Berwyn, PA (US)

(72) Inventors: Albert Tsang, Harrisburg, PA (US); Matthew Richard McAlonis, Elizabethtown, PA (US); Chong Hun Yi, Mechanicsburg, PA (US); Kyle Gary Annis, Hummelstown, PA (US); Kevin Michael Thackston, York, PA (US); Dustin Carson Belack, Hummelstown, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 0 days.

(21) Appl. No.: 14/674,068

(22) Filed: Mar. 31, 2015

(65) Prior Publication Data

US 2016/0294081 A1 Oct. 6, 2016

(51) Int. Cl.
*H01R 13/652* (2006.01)
*H01R 12/70* (2011.01)

(52) U.S. Cl.
CPC ..... *H01R 12/7005* (2013.01)

(58) Field of Classification Search
CPC . H01R 13/6453; H01R 13/645; H01R 13/652; H01R 13/648
See application file for complete search history.

(56) References Cited

U.S. PATENT DOCUMENTS 3,491,330 A * 1/1970 Barnhart ..... H01R 13/6453 439/681
4,934,950 A * 6/1990 Green ..... H01R 13/6453 439/362
4,952,175 A * 8/1990 Waters ..... H01R 13/6453 439/681
5,011,436 A * 4/1991 Waters ..... H01R 13/6453 439/681
5,096,443 A * 3/1992 Myrick ..... H01R 13/642 439/680
5,125,849 A * 6/1992 Briggs ..... G02B 6/3878 439/378
5,173,063 A * 12/1992 Barkus ..... H01R 12/737 439/633

(Continued)

OTHER PUBLICATIONS

International Search Report, Application No. PCT/US2016/020803, International Filing Date, Mar. 4, 2016.

*Primary Examiner* — Gary Paumen

(57) ABSTRACT

Configurable guide hardware is provided for aligning two associated connectors that are mounted on different circuit cards. The guide hardware includes a guide receptacle that is mounted to one of the circuit cards. The guide receptacle includes a housing that defines a channel and a keyway ring that is held in the channel. The guide receptacle is configured to receive a pin of a guide plug in the channel through a central opening of the keyway ring. The keyway ring includes a receptacle keying feature along an inner perimeter. The keyway ring is selectively positionable to locate the receptacle keying feature in multiple pre-defined angular orientations relative to the housing. The pin of the guide plug may also be selectively positionable in multiple pre-defined angular orientations.

20 Claims, 7 Drawing Sheets

(56) References Cited

U.S. PATENT DOCUMENTS

| | | | | | |
|---|---|---|---|---|---|
| 5,370,548 | A * | 12/1994 | Laudereau | H01R 13/6453 | 439/341 |
| 5,441,426 | A * | 8/1995 | Boulais | H01R 13/6453 | 439/680 |
| 6,354,885 | B1 * | 3/2002 | Bradley | H01R 12/7005 | 439/101 |
| 6,394,856 | B1 * | 5/2002 | Wertz | H01R 13/645 | 439/681 |
| 6,814,625 | B2 * | 11/2004 | Richmond | H01R 13/6453 | 439/157 |
| 6,824,403 | B2 * | 11/2004 | Hall | H01R 24/50 | 439/101 |
| 7,892,043 | B1 * | 2/2011 | Orand | H01R 13/6453 | 439/681 |
| 8,911,263 | B2 * | 12/2014 | Becavin | H01R 13/64 | 439/680 |
| 2001/0005649 | A1 * | 6/2001 | Fujioka | H01R 13/6453 | 439/378 |
| 2003/0040217 | A1 | 2/2003 | Renne et al. | | |
| 2011/0256753 | A1 | 10/2011 | Gulla | | |
| 2014/0065891 | A1 * | 3/2014 | Wang | H01R 13/6456 | 439/681 |

* cited by examiner

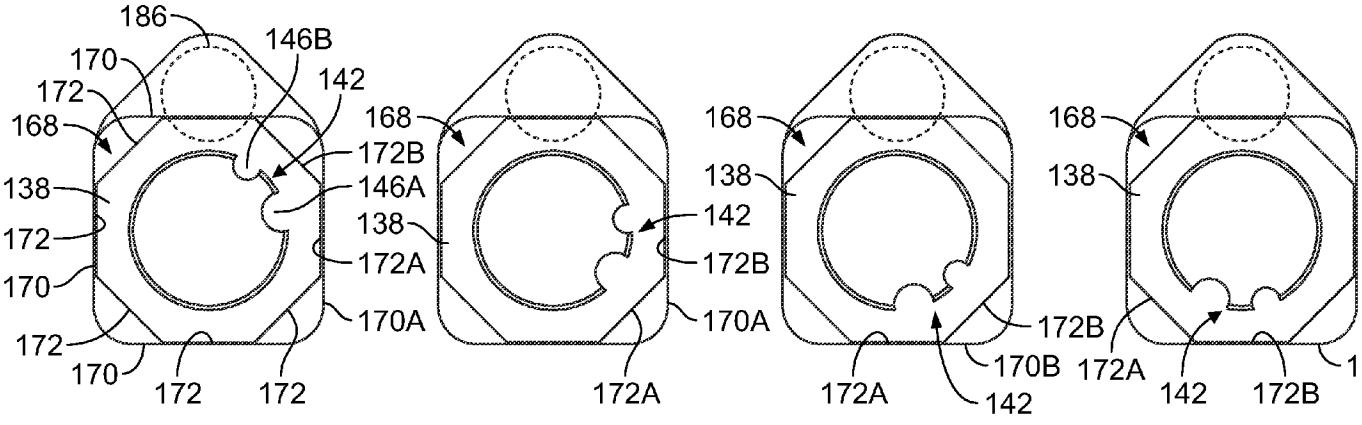
FIG. 4A
FIG. 4B
FIG. 4C
FIG. 4D
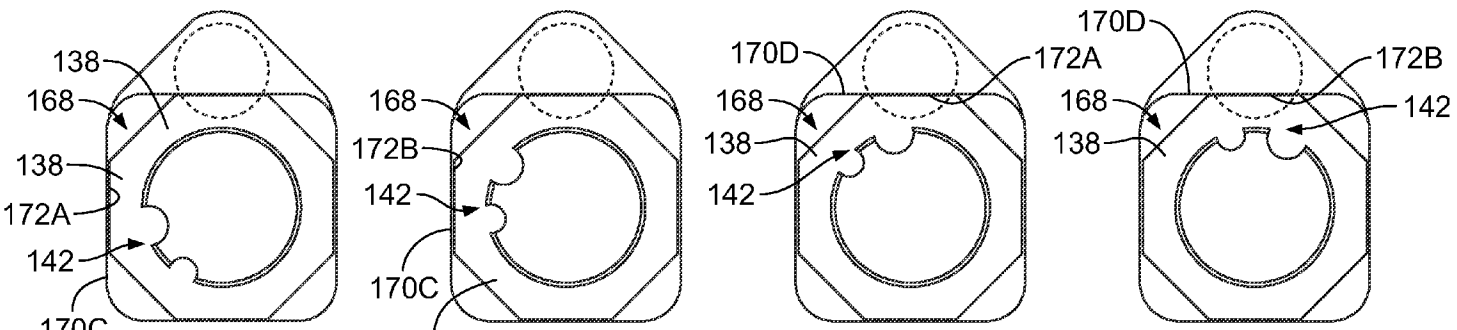
FIG. 4E
FIG. 4F
FIG. 4G
FIG. 4H

CONFIGURABLE GUIDE HARDWARE FOR CONNECTOR SYSTEMS

BACKGROUND OF THE INVENTION

The subject matter herein relates generally to guide hardware for connector systems.

Some electronic connector systems are configured to connect electrical circuit cards, such as daughter cards (or single board computers) to backplanes. The backplane may include multiple connectors such that the backplane is configured to connect to multiple different daughter cards. For example, the backplane may have twenty connectors for mating to twenty different daughter cards. In order to provide guidance for the mating between the connector on one daughter card and a corresponding connector on the backplane, guide hardware may be used to guide and align the mating circuit cards to prohibit damage from misalignment. Furthermore, the guide hardware may provide keying in order to prohibit one daughter card from connecting to the wrong connector of the multiple connectors on the backplane.

Guide hardware sets typically include a receptacle and a plug. Some known guide hardware sets are limited to, for example, five different keying configurations. As a result, these guide hardware sets are able to provide individual connector-specific keying for five different connectors, when at least twenty different keying arrangements may be required due to the number of connectors on the backplane. To address this issue, some connector systems install multiple such guide hardware sets for each daughter card in order to multiply the number of keying configurations. For example, using three such guide hardware sets that each provide five keying configurations, a total of 125 (5×5×5) potential keying configurations are provided.

However, providing additional guide hardware sets to increase the number of potential keying configurations has downsides, including a greater part cost (because of the increased number of hardware sets), a greater assembly time and cost, and a reduction in the available space on the backplane and the daughter cards due to the footprints of the multiple guide hardware sets. Due to the trend of increasing the density of electrical circuitry per area on a circuit card, it is desirable to increase the available space on the backplane, for example, by reducing the number of guide hardware sets mounted to the backplane. The real estate on the backplane that is gained may be used to provide active or passive thermal regulation devices, such as heat sinks or liquid cooling modules. The additional space may also allow for more connectors on the backplane to allow the backplane to connect with more daughter cards. But, a need remains to provide a guide hardware set that is configurable in a sufficient number of potential keying configurations to provide a specific keying configuration for each of the connectors on the backplane without requiring multiple the guide hardware sets for each connector.

BRIEF DESCRIPTION OF THE INVENTION

In one embodiment, configurable guide hardware is provided for aligning two associated connectors that are mounted on different circuit cards. The guide hardware includes a guide receptacle mounted to one of the circuit cards. The guide receptacle includes a housing that defines a channel therein. The guide receptacle further includes a keyway ring that is held in the channel. The keyway ring defines a central opening therethrough that aligns with the channel. The guide receptacle is configured to receive a pin of a guide plug in the channel through the central opening of the keyway ring. The keyway ring includes a receptacle keying feature along an inner perimeter that defines the central opening. The keyway ring is selectively positionable to locate the receptacle keying feature in multiple pre-defined angular orientations relative to the housing.

In another embodiment, a configurable guide hardware set is provided for aligning a first connector mounted to a first circuit card with an associated second connector mounted to a second circuit card. The guide hardware set includes a guide plug mounted to the first circuit card and a guide receptacle mounted to the second circuit card. The guide plug has a pin that includes a plug keying feature. The pin is selectively positionable to locate the plug keying feature in multiple pre-defined angular orientations relative to the first circuit card. The guide receptacle includes a housing that defines a channel therein. The guide receptacle further includes a keyway ring that is held in the channel. The keyway ring defines a central opening therethrough that aligns with the channel. The keyway ring includes a receptacle keying feature along an inner perimeter that defines the central opening. The keyway ring is selectively positionable to locate the receptacle keying feature in multiple pre-defined angular orientations relative to the housing. The pin of the guide plug is configured to be received in the channel of the guide receptacle through the central opening of the keyway ring when the plug keying feature is key mated with the receptacle keying feature.

BRIEF DESCRIPTION OF THE DRAWINGS

FIGS. 4A-4H illustrate a keyway ring in a pocket of the guide receptacle at various selected positions relative to the pocket.

DETAILED DESCRIPTION OF THE INVENTION

Figure 1:
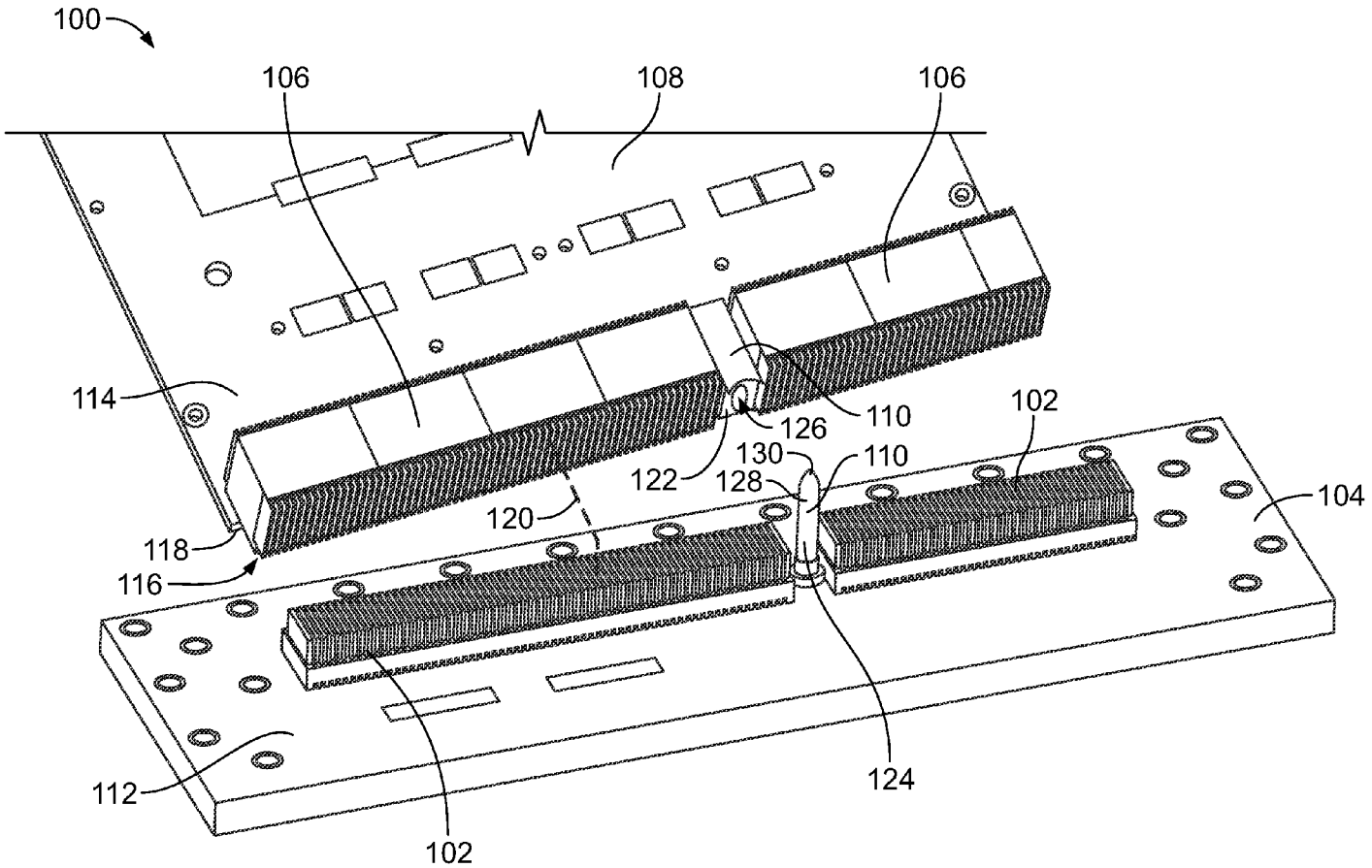
FIG. 1 is a perspective view of a connector system poised for mating according to an embodiment.

FIG. 1 is a perspective view of a connector system 100 poised for mating according to an embodiment. The connector system 100 includes a first connector 102 mounted to a first circuit card 104 and a second connector 106 mounted to a second circuit card 108. The connector system 100 further includes a guide hardware set 110. The guide hardware set 110 is configured to align the first connector 102 with the second connector 106 as the connectors 102, 106 are mated.

The circuit cards 104, 108, or circuit card assemblies, may be printed circuit boards that each hold and electrically connect various electrical components via a series of conductive tracks, pads, and the like. The first and second connectors 102, 106 are configured to mate to provide a conductive signal path between the circuit cards 104, 108. In an embodiment, the first circuit card 104 is a backplane circuit card, and the second circuit card 108 is a single board computer or daughter card. The first circuit card 104 (referred to herein as backplane circuit card 104) may be configured to include multiple connectors along a top side 112 in order to electrically connect to multiple different daughter cards. Although only the first connector 102 is shown mounted to the backplane circuit card 104 in FIG. 1, the backplane circuit card 104 may include as many as twenty or more such connectors arranged side by side along the top side 112. As used herein, relative or spatial terms such as "top," "bottom," "front," "rear," "left," and "right" are only used to distinguish the referenced elements and do not necessarily require particular positions or orientations in the connector system 100, in the guide hardware set 110, or in the surrounding environment.

The second connector 106 in FIG. 1 is an edge-mount, right angle connector. For example, the connector 106 mounts to a front side 114 of the second circuit card 108 (referred to herein as daughter card 108), and a mating end 116 of the second connector 106 extends beyond an edge 118 of the daughter card 108. During mating, the daughter card 108 is moved towards the backplane circuit card 104 along a mating axis 120 such that the second connector 106 is lowered over a top of first connector 102. Since the second connector 106 is a right angle connector, once the connectors 102, 106 are mated, the daughter card 108 extends transverse (such as perpendicular) to the backplane circuit card 104. Optionally, the connector system 100 may be formed according to the VITA 46 VPX standard for rugged embedded computing applications. The connectors 102, 106 optionally may be MULTIGIG RT 2 connectors, manufactured by Tyco Electronics Corporation.

Although not shown, the backplane circuit card 104 may be held within a chassis or housing. The chassis may include various walls that define slots. The slots may align with the connectors mounted to the backplane circuit card 104. Thus, as the daughter card 108 is moved towards the backplane circuit card 104, the daughter card 108 first enters the slot of the chassis that aligns with the first connector 102. The slot provides the first source or level of alignment between the connectors 102, 106 to ensure proper electrical mating between the backplane circuit card 104 and the daughter card 108.

The guide hardware set 110 includes multiple guide hardware, such as a guide receptacle 122 and a guide plug 124. The guide receptacle 122 defines a channel 126, and the guide plug 124 includes a pin or post 128 that is configured to be received within the channel 126 during the mating process. In the illustrated embodiment, the guide receptacle 122 is mounted to the second circuit card 108 (or daughter card 108), and the guide plug 124 is mounted to the first circuit card 104 (or backplane circuit card 104). Alternatively, the guide receptacle 122 may be mounted to the backplane circuit card 104, and the guide plug 124 is mounted to the daughter card 108. The guide hardware set 110 provides a second source or level of alignment between the connectors 102, 106. For example, if the second connector 106 on the daughter card 108 is not in alignment with the first connector 102 on the backplane circuit card 104, a tapered end 130 of the pin 128 may engage an interior surface that defines the channel 126 of the guide receptacle 122. The interaction between the pin 128 and the interior surface of the guide receptacle 122 forces the second connector 106 into better alignment with the first connector 102 prior to the connectors 102, 106 engaging one another. A third source or level of alignment is provided by the connectors 102, 106 themselves, such as through the interaction between the mating interfaces of the connectors 102, 106. The connectors 102, 106 provide the finest level of alignment.

In addition to guidance and alignment, the guide hardware set 110 provides keying in order to ensure that each daughter card electrically connects to a proper connector on the backplane circuit card 104. As stated above, the daughter card 108 shown in FIG. 1 may be one of multiple daughter cards, such as twenty or more, that are configured to electrically connect to the backplane circuit card 104. If the second connector 106 of the daughter card 108, for example, is mated to an electrical connector on the backplane circuit card 104 that is associated with a different daughter card, then the electrical signal path between the connectors may be compromised and/or the connectors may be damaged.

In an embodiment, the guide hardware set 110 is keyed such that the guide receptacle 122 mounted to the daughter card 108 is only configured to accommodate the guide plug 124 associated with the proper connector 102 on the backplane circuit card 104. For example, the guide receptacle 122 and the guide plug 124 of associated with a matching set of connectors 102, 106 have a specific keying configuration that is unique and different from the keying configurations of other guide receptacles and other guide plugs associated with different daughter cards and different connectors on the backplane circuit card 104. Thus, if the keying configurations of the guide receptacle 122 and the guide plug 124 do not match, the guide hardware set 110 mechanically blocks the connectors 102, 106 from mating to each other. In an embodiment, the guide hardware set 110 may be configurable in dozens of potential keying configurations. As a result, each of the twenty or more daughter cards that are configured to electrically connect to the backplane circuit card 104 may have a different, unique keying configuration using only one guide receptacle 122 and associated guide plug 124. This avoids the need to double or triple the number of guide receptacles 122 and guide plugs 124 for each daughter card in order to achieve a unique keying configuration. As a result, more area on the daughter card 108 and the backplane circuit card 104 is available which may be used for installing thermal regulation (heat dissipation) devices and/or increasing the number of electrical connectors and/or other electrical components on the respective circuit cards 104, 108.

Figure 2:
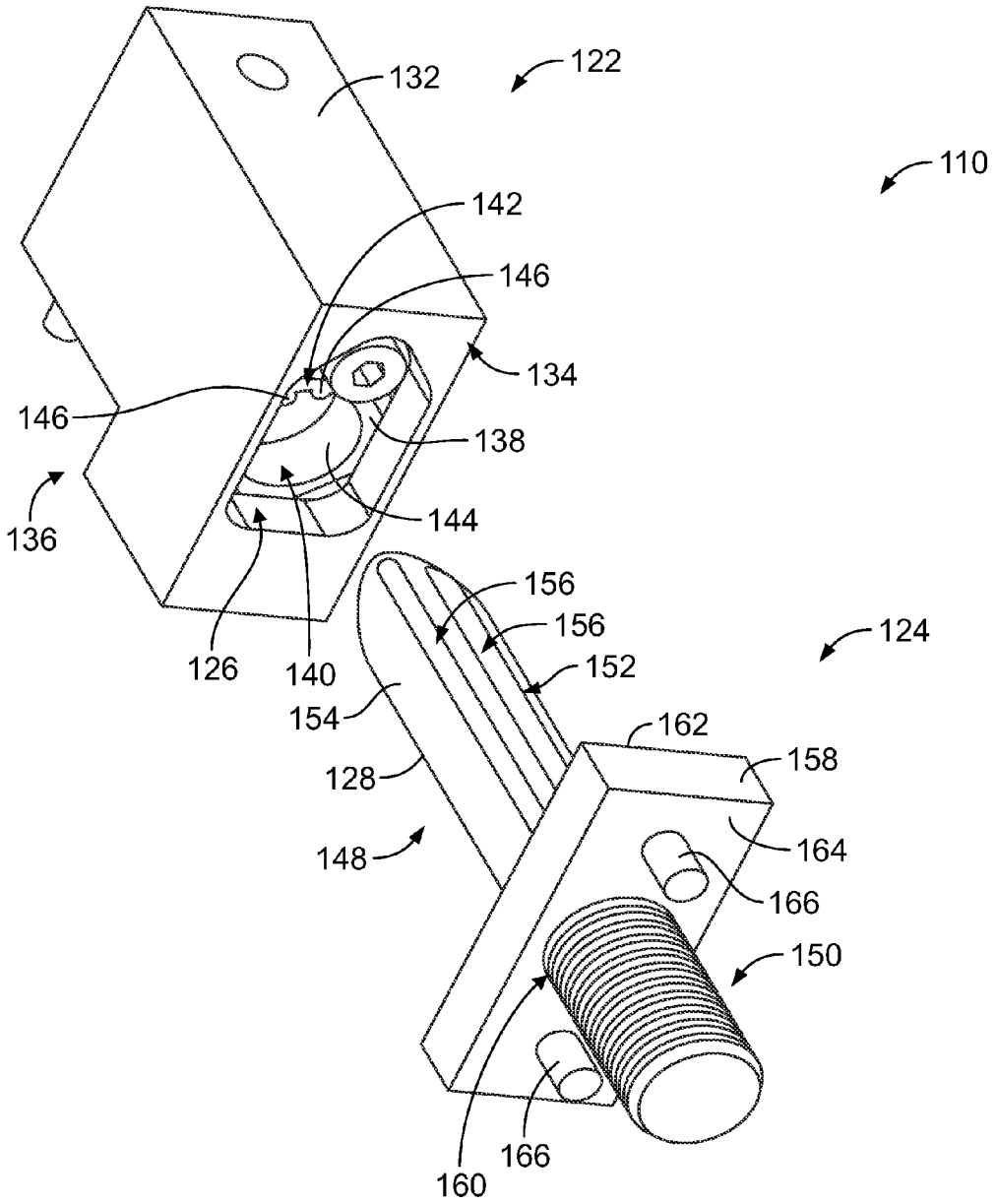
FIG. 2 is a perspective view of a guide hardware set according to an embodiment showing a guide plug poised for loading into a guide receptacle.

FIG. 2 is a perspective view of the guide hardware set 110 according to an embodiment showing the guide plug 124 poised for loading into the guide receptacle 122. In an embodiment, the guide receptacle 122 includes a housing 132. The housing 132 has a mating end 134 and a mounting end 136. In the illustrated embodiment, the guide receptacle 122 has a transverse (such as right angle) configuration and the mating end 134 is adjacent to the mounting end 136, although the mating end 134 may be opposite or at least non-adjacent to the mounting end 136 is an alternative embodiment. The housing 132 defines the channel 126 therein. The channel 126 is open at the mating end 134 of the housing 132, and the pin 128 of the guide plug 124 is configured to enter the channel 126 through the opening at the mating end 134.

The guide receptacle 122 further includes a keyway ring 138 that is held in the channel 126. The keyway ring 138 defines a central opening 140 that extends through the keyway ring 138. The central opening 140 aligns with the channel 126 of the housing 132 when the keyway ring 138 is in the channel 126. As the pin 128 of the guide plug 124 is received in the channel 126, the pin 128 extends through central opening 140 of the keyway ring 138 (assuming that the pin 128 is key mated to the keyway ring 138, which means having corresponding keying features and angular orientations). As described in more detail herein, if the pin 128 is not key mated to the keyway ring 138, then the pin 128 is not permitted to extend through the central opening 140 and is not permitted to be received into the channel 126 beyond the keyway ring 138. The keyway ring 138 includes a receptacle keying feature 142 along an inner perimeter 144 of the keyway ring 138 that defines the central opening 140. The receptacle keying feature 142 is one or more protrusions that extend inward at least partially into the central opening 140 and/or one or more grooves that extend outward (towards an outer perimeter of the keyway ring 138). In the illustrated embodiment, the receptacle keying feature 142 is two protrusions 146.

As described further herein, the keyway ring 138 is selectively positionable relative to the housing 132 in order to locate the receptacle keying feature 142 in multiple pre-defined angular orientations. The ability to selectively position the keyway ring 138 in one of multiple different angular orientations provides multiple potential keying configurations using the same guide receptacle 122 (instead of having to use different guide receptacles to achieve the same number of keying configurations). In addition, the guide receptacle 122 is able to accomplish the multiple potential keying configurations without affecting the footprint of the guide receptacle 122 on the daughter card 108 (shown in FIG. 1). For example, the guide receptacle 122 is configured to allow the keyway ring 138 to be selectively positionable without moving the housing 132 relative to the daughter card 108. The keyway ring 138 optionally may be substitutable within the housing 132 for another keyway ring that has a different receptacle keying feature but that is also selectively positionable within the housing 132. Thus, by having multiple keyway rings to choose from, the number of potential keying configurations of the guide receptacle 122 increases exponentially.

The guide plug 124 includes the pin 128 which extends longitudinally along a length. The pin 128 includes a mating segment 148 and a mounting segment 150. At least a portion of the mating segment 148 is configured to be received in the channel 126 of the guide receptacle 122. At least a portion of the mounting segment 150 is configured to engage and/or extend through the backplane circuit card 104 (shown in FIG. 1) to mount the guide plug 124 to the backplane circuit card 104. The pin 128 has a plug keying feature 152 defined on and/or along an exterior surface 154 the mating segment 148. The plug keying feature 152 is one or more grooves that extend radially inward from the exterior surface 154 and/or one or more protrusions that extend radially outward from the exterior surface 154. In the illustrated embodiment, the plug keying feature 152 is two grooves 156. The two grooves 156 extend parallel to one another along a length of the mating segment 148.

As described further herein, the pin 128 is selectively positionable relative to the backplane circuit card 104 in order to locate the plug keying feature 152 in multiple pre-defined angular orientations. The ability to selectively position the pin 128 in one of multiple different angular orientations provides multiple potential keying configurations using the same pin 128 (instead of having to use different guide plugs to achieve the same number of keying configurations). In addition, the guide plug 124 is able to accomplish the multiple potential keying configurations without affecting the footprint of the guide plug 124 on the backplane circuit card 104 (shown in FIG. 1). For example, the guide plug 124 occupies the same space on the backplane circuit card 104 for each of the multiple angular orientations of the pin 128.

In an embodiment, the guide plug 124 further includes a base 158 that mounts to the backplane circuit card 104 (shown in FIG. 1). The base 158 has a top side 162 and a bottom side 164. Pegs 166 extend from the bottom side 164 of the base 158. The pegs 166 may be received in through-holes or vias in the backplane circuit card 104 to secure the base 158 to the circuit card 104. In an embodiment, the base 158 does not rotate or otherwise change positions relative to the backplane circuit card 104 as the pin 128 is selectively rotated to another angular position. In the illustrated embodiment, the pin 128 extends through the base 158, such as through a slot 160 in the base 158. The base 158 is positioned relative to the pin 128 such that the mating segment 148 of the pin 128 extends from the top side 162 of the base 158, and the mounting segment 150 extends from the bottom side 164 of the base 158. In alternative embodiment, the pin 128 does not extend fully through the base 158. For example, the mounting segment 150 of the pin 128 may be secured only to the base 158, such that the pin 128 is indirectly mounted to the backplane circuit card 104 via the base 158.

In the illustrated embodiment, the plug keying feature 152 of the guide plug 124 is key mated (or key mate-able) with the receptacle keying feature 142 of the guide receptacle 122. As used herein, keying features are key mated if the keying size, number, shape, spacing, and angular positioning of the keying features are complementary such that the pin 128 is able to be received fully within the channel 126 through the central opening 140 of the keyway ring 138. For example, in FIG. 1 the plug keying feature 152 includes two grooves 156 and the receptacle keying feature 142 includes two protrusions 146. The protrusions 146 and the grooves 156 have complementary sizes, shapes, numbers, and spacing between each set. In addition, the keyway ring 138 and the pin 128 are each in a respective selected position such that the angular orientation of the receptacle keying feature 142 (for example, the protrusions 146) aligns with the angular orientation of the plug keying feature 152 (for example, the grooves 156). Since receptacle and plug keying features 142, 152 are complementary in the illustrated embodiment, as the pin 128 is loaded into the channel 126, each protrusion 146 is received within a corresponding groove 156 of the pin 128.

The receptacle keying feature 142 must be key mated to the plug keying feature 152 in order to allow the pin 128 to extend fully into the channel 126. As a result, the receptacle keying feature 142 must be key mated to the plug keying feature 152 to allow the first connector 102 on the backplane circuit card 104 to mate and electrically connect to the second connector 106 on the daughter card 108. If the receptacle keying feature 142 and the plug keying feature 152 are not key mated, such as if size, shape, number, spacing, and/or angular orientation differs, the keyway ring 138 is configured to restrict the pin 128 from further access into the channel 126, which prevents a daughter card from being mistakenly electrically connected to a non-associated connector on the backplane circuit card.

Figure 3:
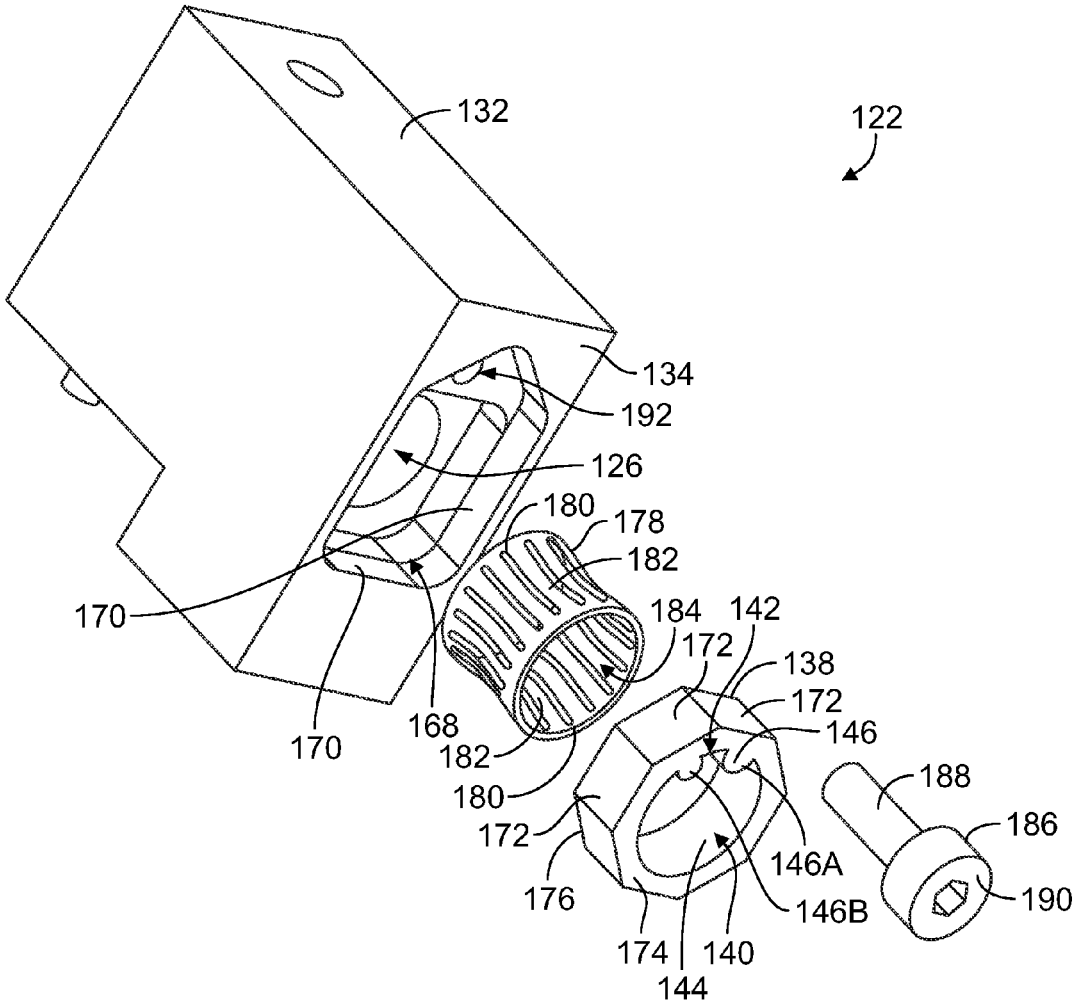
FIG. 3 is an exploded perspective view of the guide receptacle of the guide hardware set according to an embodiment.

FIG. 3 is an exploded perspective view of the guide receptacle 122 of the guide hardware set 110 (shown in FIG. 2) according to an embodiment. The housing 132 of the guide receptacle 122 may be composed at least partially of a conductive material, such as one or more metals. The housing 132 may be formed through a molding process, such as die casting or injection molding. Alternatively, the housing 132 may be produced by machining. The housing 132 defines a pocket 168, which is a section of the channel 126 proximate to the mating end 134 of the housing 132. The pocket 168 may have a larger cross-sectional area than another section of the channel 126 more distal from the mating end 134. The pocket 168 is configured to receive and hold the keyway ring 138. For example, the pocket 168 is configured to hold the keyway ring 138 in each of the selected positions of the keyway ring 138. The pocket 168 is defined by pocket walls 170 that are configured to engage perimeter surfaces 172 of the keyway ring 138 to retain the selected position of the keyway ring 138 such that the keyway ring 138, when in a selected position, is mechanically blocked from rotating to another position.

The keyway ring 138 has a first side 174 and an opposite second side 176. The keyway ring 138 has a series of perimeter surfaces 172 that together define the outer perimeter of the keyway ring 138. The perimeter surfaces 172 extend between the first and second sides 174, 176. In an embodiment, the perimeter surfaces 172 are each straight or linear with angled corners or vertices between two adjacent surfaces. Alternatively, the corners may be curved. In another embodiment, at least some of the perimeter surfaces 172 are curved instead of being straight. The outer perimeter of the keyway ring 138 may define a polygon having at least three perimeter surfaces 172. In the illustrated embodiment, the keyway ring 138 has an octagonal outer perimeter with eight perimeter surfaces 172, but in other embodiments the keyway ring 138 may have three, four, five, six, seven, or more than eight perimeter surfaces 172. The keyway ring 138 may be composed at least partially of a conductive material, such as one or more metals. The keyway ring 138 may be formed via a molding process, an extrusion process, a machining process, or the like.

The receptacle keying feature 142 of the keyway ring 138 in the illustrated embodiment is a pair of protrusions 146 including a first or primary protrusion 146A and a second or secondary protrusion 146B. The primary and secondary protrusions 146A, 146B extend into the central opening 140 from the inner perimeter 144 of the keyway ring 138, and are spaced apart from one another circumferentially along the inner perimeter 144. The primary protrusion 146A may have a different size and/or shape than the secondary protrusion 146B. For example, in the illustrated receptacle keying feature 142, the primary protrusion 146A has generally the same shape as the secondary protrusion 146B, but the primary protrusion 146A is larger in size than the secondary protrusion 146B. Thus, the primary protrusion 146A is configured to be received in a corresponding groove 156 (shown in FIG. 2) in the pin 128 (FIG. 2) of the guide plug 124 (FIG. 2) that is larger in size than a corresponding groove 156 in the pin that is sized to accommodate the secondary protrusion 146B. The primary protrusion 146A may be too large to be received in the smaller groove 156 that corresponds to the secondary protrusion 146B. The primary and secondary protrusions 146A, 146B shown in FIG. 3 have a similar shape as both are curved and generally semi-circular, although the primary protrusion 146A may be wider than the secondary protrusion 146B. In an alternative embodiment, the protrusions 146A, 146B may have different shapes from one another. For example, at least one of the protrusions 146A, 146B may be rectangular, triangular, trapezoidal, oval-shaped, or the like.

Although two protrusions 146 are shown and described in FIG. 3, other keyway rings may have one, three, or more than three protrusions. For example, the three or more protrusions are located at different spaced-apart locations along the inner perimeter of the keyway ring. Another keyway ring may have at least one protrusion extending into the central opening 140 and also at least one groove extending outward towards an outer perimeter of the keyway ring. Thus, different keying rings may have receptacle keying features that include different numbers of protrusions, different spacing between the protrusions along the inner perimeter, different sizes of protrusions, and/or different shapes of protrusions, as well as different numbers, spacing, sizes, and/or shapes of grooves in order to provide unique keying configurations.

As shown in FIG. 3, the guide receptacle 122 also includes a grounding band 178. The grounding band 178 is configured to simultaneously engage a conductive interior surface of the housing 132 and the conductive exterior surface 154 (shown in FIG. 2) of the pin 128 (FIG. 2) within the channel 126 to provide an electrical ground path between the guide receptacle 122 and the guide plug 124 (FIG. 2). The grounding band 178 is composed of a conductive material, such as one or more metals. The grounding band 178 may be stamped and formed into a cylindrical shape. The grounding band 178 includes end rings 180 and a plurality of ribs 182 that extend between the end rings 180. A cavity 184 extends though the grounding band 178. In an embodiment, the ribs 182 are bowed radially inwards such that a diameter of the cavity 184 along a middle section is less than the diameter at the end rings 180. As a result, when the grounding band 178 is loaded into the channel 126, the cavity 184 aligns with the channel 126 and at least an outer surface of the grounding band 178 along the end rings 180 engages the interior surface of the housing 132. As the pin 128 of the guide plug 124 is received in the channel 126, the pin 128 extends through the cavity 184 and engages the bowed ribs 182. The bowed ribs 182 may at least partially deflect outwards while retaining a biased mechanical engagement with the pin 128. Thus, simultaneous mechanical engagement with the interior surface of the housing 132 and the pin 128 allows the grounding band 178 to provide an electrically conductive ground path that is reliable. In an alternative embodiment, the grounding band 178 may have deflectable cantilevered beams instead of the ribs 182 which are each attached at both ends.

During assembly, the grounding band 178 may be loaded into the channel 126 of the housing 132 beyond the pocket 168, and then the keyway ring 138 may be loaded into the pocket 168. Optionally, the keyway ring 138 is selectively oriented (for example, invertible) within the pocket 168. For example, in a first or normal orientation, the keyway ring 138 is loaded into the pocket 168 such that the first side 174 of the keyway ring 138 is more proximate to the mating end 134, after loading, than the second side 176 (meaning the proximity of the second side 176 to the mating end 134). The keyway ring 138 is in the normal orientation in FIG. 3. However, in an inverted orientation, second side 176 is more proximate to the mating end 134 than the first side 174. This invertibility of the keyway ring 138 in the pocket 168 may double the number of potential keying configurations of the keyway ring 138. For example, the primary protrusion 146A is to the right of the secondary protrusion 146B in the normal orientation, and is to the left of the secondary protrusion 146B in the inverted orientation. Instead of inverting the keyway ring 138, different keying configurations are achievable by substituting the keyway ring 138 that is shown in FIG. 3 for another keyway ring that has a different receptacle keying feature.

The guide receptacle 122 may further include a locking fastener 186 configured to couple to the housing 132 to secure the keyway ring 138 within the pocket 168. The locking fastener 186 includes a shaft 188 and a head 190. The shaft 188 is configured to be received in a corresponding hole 192 along or proximate to the mating end 134 of the housing 132. The hole 192 is proximate to the pocket 168 such that when the locking fastener 186 is coupled to the housing 132 through the hole 192, a portion of the head 190 extends over the pocket 168. Therefore, once the keyway ring 138 is loaded into the pocket 168, the locking fastener 186 may be coupled to (or tightened relative to) the housing 132, which causes the head 190 to extend over the keyway ring 138 and block the keyway ring 138 from exiting the pocket 168. The locking fastener 186 thus secures the keyway ring 138 in a selected position to lock the angular orientation of the receptacle keying feature 142. The locking fastener 186 may be a bolt, a screw, a spring-loaded arm, a latch, or the like.

FIGS. 4A-4H illustrate the keyway ring 138 in the pocket 168 of the housing 132 (shown in FIG. 3) at various selected positions relative to the housing 132. In an embodiment, when the keyway ring 138 is in a selected position within the pocket 168, at least some of the perimeter surfaces 172 of the keyway ring 138 engage at least some of the pocket walls 170, and the engagement prohibits the keyway ring 138 from rotating relative to the housing 132 out of the selected position. For example, the pocket 168 in the illustrated embodiment includes four pocket walls 170, and the pocket 168 is in the shape of a square with rounded corners. In alternative embodiments, the pocket 168 may have other shapes and/or another number of pocket walls 170.

In FIGS. 4A-4H the only variable between the illustrated keyway rings 138 is the selected position of the keyway ring 138 in the pocket 168. The keyway ring 138 is in a different selected position in each of FIGS. 4A-4H. Two different selected positions differ in the rotational position of the keyway ring 138, which locates the receptacle keying feature 142 in different pre-defined angular orientations. In the illustrated embodiment, the keyway ring 138 has an octagonal outer perimeter composed of a series of eight perimeter surfaces 172. As a result, the keyway ring 138 is selectively positionable to locate the receptacle keying feature 142 in one or eight different angular orientations. At each selected position, four of the eight perimeter surfaces 172 are configured to engage the four pocket walls 170. It is recognized that there may be some clearance between the perimeter surfaces 172 and the pocket walls 170 such that not all of the four perimeter surfaces 172 may mechanically contact the corresponding pocket walls 170 at the same time. Yet, the size of the pocket 168 is designed with limited clearance such that the keyway ring 138 must be at least partially removed from the pocket 168 in order to rotate the keyway ring 138 to a different selected position. Within the pocket 168 the keyway ring 138 is secured in position by the pocket walls 170 and the locking fastener 186 (shown in phantom in FIGS. 4A-4H), which prohibits the keyway ring 138 from falling out of the pocket 168.

Referring to FIGS. 4A-4H specifically, the primary protrusion 146A of the receptacle keying feature 142 is most proximate to a first perimeter surface 172A of the eight perimeter surfaces 172 of the keyway ring 138. The secondary protrusion 146B is most proximate to a second perimeter surface 172B that is adjacent to the first perimeter surface 172A. In FIG. 4A, the keyway ring 138 is in a first selected position. The first perimeter surface 172A is engaged with a right pocket wall 170A of the pocket 168, the second perimeter surface 172B does not engage any of the pocket walls 170, and the receptacle keying feature 142 has a northeast radial orientation. In FIG. 4B, the keyway ring 138 is in a second selected position. The first perimeter surface 172A does not engage any of the pocket walls 170, the second perimeter surface 172B engages the right pocket wall 170A of the pocket 168, and the receptacle keying feature 142 has an east radial orientation.

In a third selected position of the keyway ring 138 shown in FIG. 4C, the first perimeter surface 172A is engaged with a bottom pocket wall 170B of the pocket 168, the second perimeter surface 172B does not engage any of the pocket walls 170, and the receptacle keying feature 142 has a southeast radial orientation. In FIG. 4D, the keyway ring 138 is in a fourth selected position. The first perimeter surface 172A does not engage any of the pocket walls 170, the second perimeter surface 172B engages the bottom pocket wall 170B, and the receptacle keying feature 142 has a south radial orientation. The trend continues for the next four selected positions of the keyway ring 138. For example, in a fifth selected position shown in FIG. 4E, the first perimeter surface 172A engages a left pocket wall 170C, and the receptacle keying feature 142 has a southwest radial orientation. In a sixth selected position shown in FIG. 4F, the second perimeter surface 172B engages the left pocket wall 170C, and the receptacle keying feature 142 has a west radial orientation. In a seventh position shown in FIG. 4G, the first perimeter surface 172A engages a top pocket wall 170D, and the receptacle keying feature 142 has a northwest radial orientation. Finally, in an eighth position shown in FIG. 4H, the second perimeter surface 172B engages the top pocket wall 170D, and the receptacle keying feature 142 has a north radial orientation. Therefore, each perimeter surface 172 of the keyway ring 138 (for example, the first perimeter surface 172A) engages a different one of the pocket walls 170A-D at different selected positions of the keyway ring 138 in the pocket 168.

Figure 5:
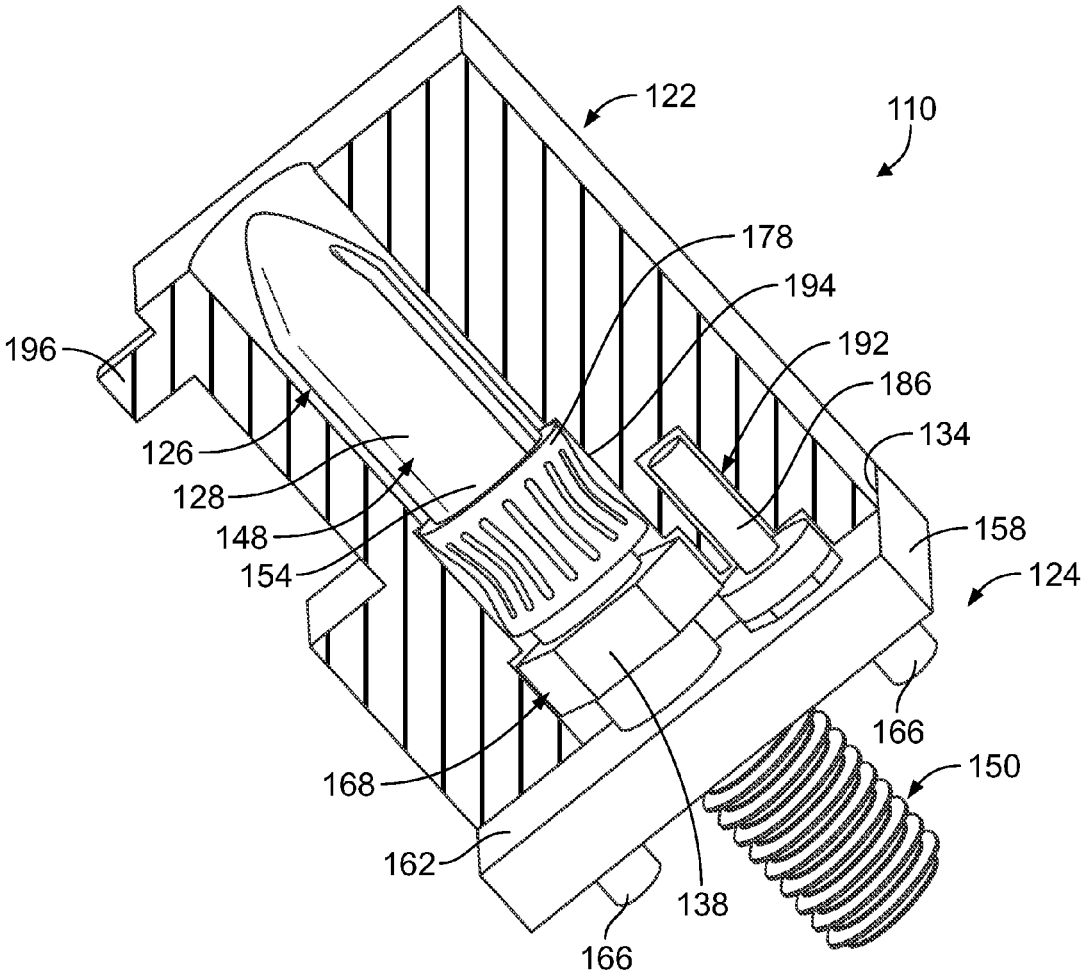
FIG. 5 is a perspective view of the guide hardware set according to an embodiment showing the guide plug loaded in the guide receptacle.

FIG. 5 is a perspective view of the guide hardware set 110 according to an embodiment showing the guide plug 124 loaded in the guide receptacle 122. The guide receptacle 122 is shown in cross-section in FIG. 5. The pin 128 of the guide plug 124 is within the channel 126, and the top side 162 of the base 158 abuts or is at least proximate to the mating end 134 of the housing 132. The keyway ring 138 is held within the pocket 168, and the locking fastener 186 is coupled to the housing 132 through the hole 192 to retain the keyway ring 138 in the pocket 168. The grounding band 178 is within the channel 126 and is in mechanical engagement with both an interior surface 194 of the housing 132 that defines the channel 126 and the exterior surface 154 of the pin 128.

As described above, the grounding band 178 provides an electrical grounding path between the daughter card 108 (shown in FIG. 1) and the backplane circuit card 104 (FIG. 1) through the guide hardware set 110. For example, the housing 132 includes at least one mounting post 196 that is electrically connected to the daughter card 108. The housing 132 may be formed of a conductive metal, such that a conductive path extends from the mounting post 196 to the interior surface 194 that defines the channel 126. The conductive path extends through the grounding band 178 between the interior surface 194 and the pin 128. The pin 128 is conductive. Optionally, the mounting segment 150 of the pin 128 may be electrically connected to the backplane circuit card 104 such that the electrical ground path extends through the pin 128 directly to the backplane circuit card 104. Alternatively, the ground path may extend from the mating segment 148 of the pin 128 through the base 158 and into the backplane circuit card 104 via the pegs 166.

Figure 6:
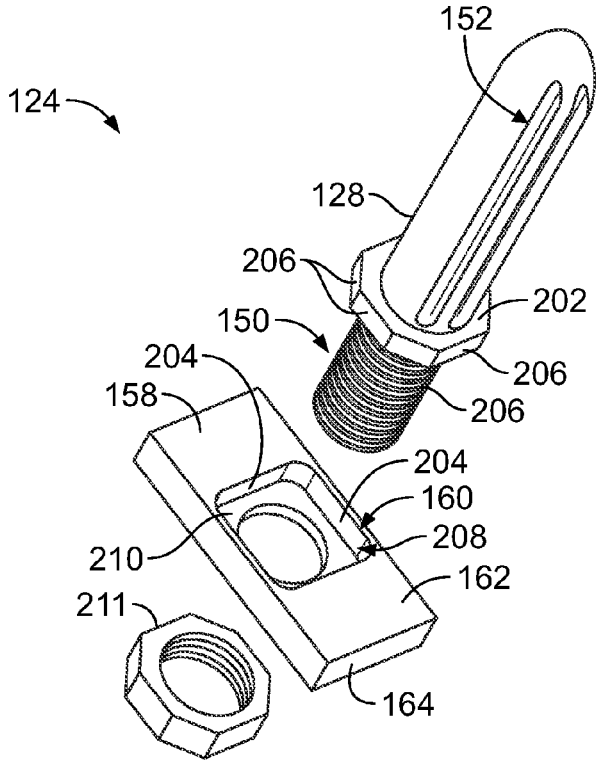
FIG. 6 is an exploded view of the guide plug according to one embodiment.

FIG. 6 is an exploded view of the guide plug 124 according to one embodiment. The guide plug 124 includes the pin 128 and the base 158. As described above, the base 158 defines a slot 160 that extends between the top side 162 and the bottom side 164 of the base 158. The pin 128 is configured to extend through the slot 160 to mount to the backplane circuit card 104 (shown in FIG. 1). The pin 128 is selectively positionable within the slot 160 to locate the plug keying feature 152 on the pin 128 in multiple predefined angular orientations. In the illustrated embodiment, the pin 128 includes a flange 202, and the pin 128 is selectively positionable due to flange 202 interacting with guide walls 204 that define at least part of the slot 160.

The flange 202 extends around a perimeter of the pin 128 and has a series of perimeter surfaces 206. In the illustrated embodiment, the flange 202 has an octagonal outer perimeter with eight perimeter surfaces 206, but the flange 202 may have a different number of perimeter surfaces 206 in other embodiments. At least a top portion 208 of the slot 160, which extends from the top side 162 of the base 158, has a polygonal shape defined by multiple guide walls 204. In the illustrated embodiment, the top portion 208 of the slot 160 has four guide walls 204 in a rectangular or square shape. The guide walls 204 are generally linear with rounded corners between adjacent guide walls 204. The guide plug 124 is assembled by loading the pin 128, mounting segment 150 first, into the slot 160 from the top side 162 downwards. The flange 202 is received in the top portion 208 of the slot 160, and at least some of the perimeter surfaces 206 engage at least some of the guide walls 204. The flange 202 abuts a ledge 210 in the slot 160 which provides a bottom support for the flange 202 and blocks further movement of the pin 128 in the downward direction. The top portion 208 of the slot 160 is defined between the top side 162 and the ledge 210. The pin 128 is selectively positionable by rotating the pin 128 in different angular orientations relative to the base 158 and then loading the flange 202 into the top portion 208 of the slot 160. The interaction between the perimeter surfaces 206 and the abutting guide walls 204 locks the pin 128 in a selected position. A nut 211 may be threaded on the mounting segment 150 below the bottom side 164 of the base 158 after the pin 128 is loaded in the slot 160. The nut 211 couples the pin 128 to the base 158 and/or the backplane circuit card 104 to hold the flange 202 in the slot 160. Alternatively, a clip or another fastening member may be used to retain the pin 128 in the base 158 and/or the backplane circuit card 104 instead of the nut 211.

Since the flange 202 in the illustrated embodiment has eight perimeter surfaces 206, the pin 128 is selectively positionable in eight different positions in order to provide eight rotational orientations of the plug keying feature 152. The number of possible rotational orientations of the plug keying feature 152 may equal the number of possible rotational orientations of the receptacle keying feature 142 (shown in FIG. 3) in order for the same guide plug 124 to be able to be key mated to the same guide receptacle 122 in eight keying configurations. For example, just because the plug keying feature 152 is congruent with the receptacle keying feature 142 in size, shape, number, and spacing, the guide plug 124 is not key mated to the guide receptacle 122 (shown in FIG. 3) if the angular orientations of the keying features 142, 152 are not congruent as well. As described above, the receptacle keying feature 142 is key mated to the plug keying feature 152 when both (a) the at least one groove 156 of the plug keying feature 152 is sized and shaped to receive the corresponding at least one protrusion 146 (shown in FIG. 3) of the receptacle keying feature 142, and (b) the selected angular orientation of the receptacle keying feature 142 is aligned with the selected angular orientation of the plug keying feature 152. Therefore, the keying features 142, 152 must be in corresponding orientations of the eight angular orientations in order for the guide plug 124 to be key mated to the guide receptacle 122.

Figure 7:
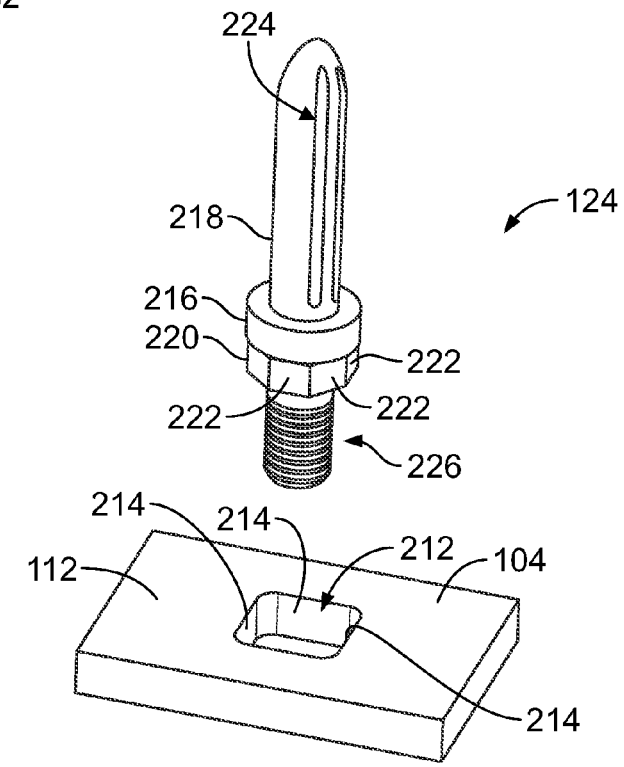
FIG. 7 is an exploded view of the guide plug according to an alternative embodiment showing the guide plug poised for loading into a portion of a circuit card.

FIG. 7 is an exploded view of the guide plug 124 according to an alternative embodiment shown poised for loading into a portion of the backplane circuit card 104. The guide plug 124 in FIG. 7 does not include a base. The guide plug 124 includes a pin 218 that has a positioning flange 220 that is configured to be received in an aperture 212 of the backplane circuit card 104 (or another circuit card). The aperture 212 is defined by card walls 214 of the circuit card 104. In the illustrated embodiment, the positioning flange 220 has a similar shape and function as the flange 202 of the guide plug 124 shown in FIG. 6, and the aperture 212 has a similar shape and function as the top portion 208 of the slot 160 of the base 158 (all three shown in FIG. 6). For example, the guide plug 124 in FIG. 7 is configured to be selectively positioned by loading the positioning flange 220 in the aperture 212 in a selected one of multiple different angular positions or orientations relative to the circuit card 104. At least some perimeter surfaces 222 of the positioning flange 220 engage corresponding card walls 214 when the pin 218 is in a selected position to prohibit rotation of the pin 218 away from the selected position.

The aperture 212 in the backplane circuit card 104 shown in FIG. 7 does not include a structure like the ledge 210 (shown in FIG. 6) of the base 158 on which the positioning flange 220 sits. Instead, the pin 218 defines a seating flange 216 above the positioning flange 220 (such as between the positioning flange 220 and a plug keying feature 224 of the pin 218). The seating flange 216 is configured to extend laterally beyond at least some of the perimeter surfaces 222 such that the seating flange 216 engages the top side 112 of the backplane circuit card 104 instead of being received within the aperture 212. The seating flange 216 blocks downward vertical movement of the pin 218 relative to the circuit card 104, and a nut (such as the nut 211 shown in FIG. 6) or another fastening member may be coupled to a mounting segment 226 of the pin 218 below the circuit card 104 to secure the pin 218 to the backplane circuit card 104.

Figure 8:
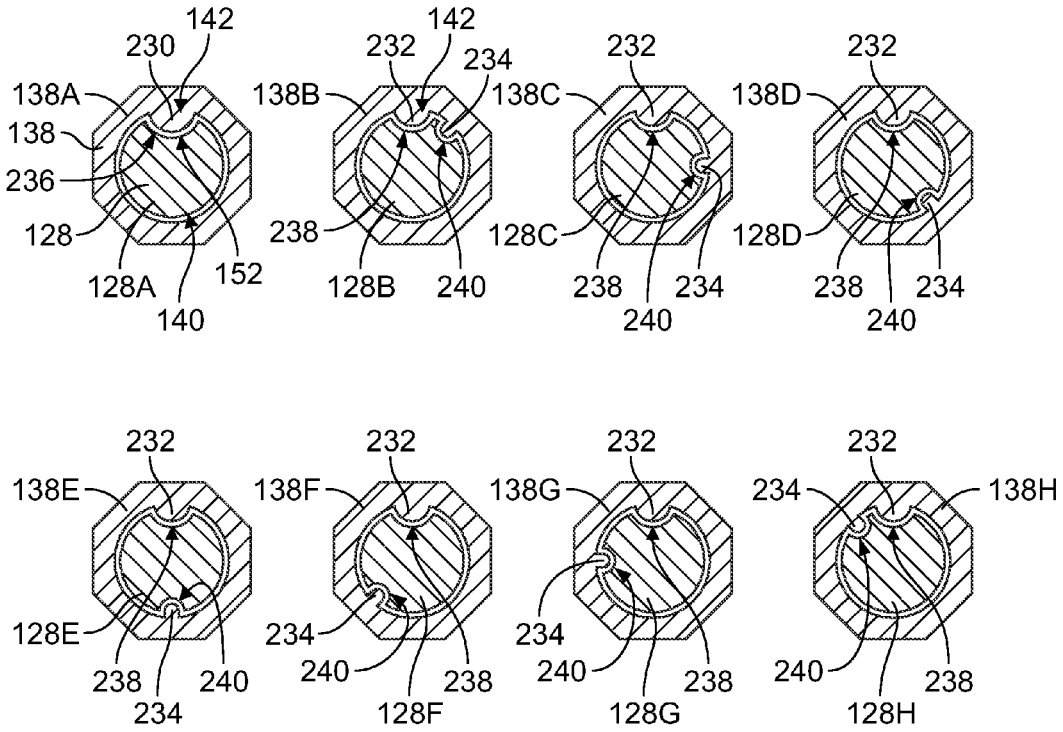
FIG. 8 is a cross-sectional view of multiple keyway rings and pins of the guide hardware set according to an embodiment.

FIG. 8 is a cross-sectional view of multiple keyway rings 138 and pins 128 of the guide hardware set 110 (shown in FIG. 2) according to an embodiment. The pins 128 are within the keyway rings 138. Each keyway ring 138 has a receptacle keying feature 142 that is key mated to a plug keying feature 152 of the corresponding pin 128 within the central opening 140 of the respective keyway ring. In the illustrated embodiment, the receptacle keying features 142 are protrusions and the plug keying features 152 are grooves. As described above, when the receptacle keying feature 142 is key mated to the plug keying feature 152, each protrusion of the keyway ring 138 is received in a corresponding groove of the pin 128 as the pin 128 is received through the central opening 140 of the keyway ring 138.

FIG. 8 shows eight keyway rings 138A-H that have different receptacle keying features 142, and eight pins 128A-H that have different plug keying features 152. The first keyway ring 138A has a single protrusion 230. Each of the other seven keyway rings 138B-H has two protrusions, a first or primary protrusion 232 and a second or secondary protrusion 234. The primary protrusion 232 has a different shape and/or size than the secondary protrusion 234. In the illustrated embodiment, the primary protrusion 232 is larger in size (for example, has a greater cross-sectional area) and has a wider shape than the secondary protrusion 234. The primary protrusion 232 is smaller, however, than the protrusion 230 of the first keyway ring 138A.

In the illustrated embodiment, the primary protrusions 232 in each of the keyway rings 138B-H have the same size and shape, and the secondary protrusions 234 in each of the keyway rings 138B-H also have the same size and shape. The only difference between the receptacle keyway features 142 of the keyway rings 138B-H is the relative spacing of the secondary protrusion 234 to the primary protrusion 232. For example, in the second keyway ring 138B the secondary protrusion 234 is approximately 45 degrees from the primary protrusion 232 in the clockwise direction. In the third keyway ring 138C the secondary protrusion 234 is approximately 90 degrees from the primary protrusion 232. The secondary protrusion 234 is approximately 135 degrees from the primary protrusion 232 in the fourth keyway ring 138D. The secondary protrusion 234 is approximately 180 degrees from the primary protrusion 232 in the fifth keyway ring 138E. In the sixth keyway ring 138F, the secondary protrusion 234 is approximately 225 degrees from the primary protrusion 232 in the clockwise direction (or 135 degrees in the counterclockwise direction). The secondary protrusion 234 is approximately 270 degrees clockwise (or 90 degrees counterclockwise) from the primary protrusion 232 in the seventh keyway ring 138G. In the eighth keyway ring 138H, the secondary protrusion 234 is approximately 315 degrees clockwise (or 45 degrees counterclockwise) from the primary protrusion 232. Optionally, the sixth, seventh, and eighth keyway rings 138F, 138G, 138H are inverted orientations of the fourth, third, and second keyway rings 138D, 138C, 138B, respectively. Thus, inverting the second, third, and fourth keyway rings 138B-D provides a different receptacle keying feature 142 for each keyway ring 138B-D. As a result, only five different keyway ring parts may be needed to provide the eight keyway rings 138A-H shown in FIG. 8.

The first pin 128A has a single groove 236 that is sized to receive the protrusion 230 of the first keyway ring 138A. The second through eighth pins 128B-H each include a primary groove 238 that is configured to receive the primary protrusion 232 and a secondary groove 240 that is configured to receive and accommodate the secondary protrusion 234 of the respective receptacle keying feature 142. For example, the primary groove 238 is larger in size than the secondary groove 240, but is smaller in size than the groove 236 in the first pin 128A. Like the protrusions 232, 234, the primary and secondary grooves 238, 240 for each of the second through eighth pins 128B-H have different relative positioning or spacing. Each of the pins 128A-H is only able to be received in the central opening 140 of the corresponding keyway ring 138A-H. In addition, each of the keyway rings 138A-H is only able to receive the corresponding pin 128A-H. For example, the first keyway ring 138A only has the one protrusion 230, but the protrusion 230 is larger than both the primary groove 238 and the secondary groove 240 so the protrusion 230 is not able to be received in any other grooves besides the groove 236 of the first pin 128A.

Each of the eight keyway rings 138A-H in the illustrated embodiment have an octagonal outer perimeter and are selectively positionable in eight different angular orientations, as shown and described in FIGS. 4A-H. Thus, since there are eight different receptacle keying features 142 (for example, one for each of the keyway rings 138A-H) and each receptacle keying feature 142 has eight different angular orientations, a single guide hardware set 110 (shown in FIG. 2) is able to provide sixty-four possible keying configurations. For example, the guide receptacle 122 (shown in FIG. 2) may have one of the eight substitutable keyway rings 138A-H loaded in the channel 126 (FIG. 2). The keyway rings 138A-H may have identifying indicia, such as numbers or color-coding, thereon to distinguish between the keyway rings 138A-H. In addition, the selected one of the eight keyway rings 138A-H may be in the channel 126 in a selected one of eight different angular orientations. The keyway ring 138 in the guide receptacle 122 only key mates to a corresponding pin 128 of the eight pins 128A-H shown in FIG. 8, and only if the corresponding pin 128 is in a selected position of the eight different angular orientations (described in FIG. 6) that corresponds or matches the angular orientation of the keyway ring 138. Although sixty-four different keying configurations are achievable according to the illustrated embodiment, the guide hardware set 110 may have more or less than sixty-four keying configurations in other embodiments by having a different number of receptacle and plug keying features and/or having a different number of selectable angular positions of the keyway rings and the pins.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. Configurable guide hardware for aligning two associated connectors that are mounted on different circuit cards, the guide hardware comprising:

a guide receptacle mounted to one of the circuit cards, the guide receptacle including a housing that defines a channel therein, the housing extending between a mating end and an opposite end, the channel being open at the mating end and extending towards the opposite end, the guide receptacle further including a keyway ring having a first side and a second side and defining a central opening therethrough between the first and second sides, the keyway ring held in the channel such that the first and second sides are both located axially between the mating end and the opposite end of the housing, the central opening of the keyway ring aligning with the channel, the guide receptacle being configured to receive a pin of a guide plug in the channel through the central opening of the keyway ring, the keyway ring including a receptacle keying feature along an inner perimeter that defines the central opening, the keyway ring being selectively positionable to locate the receptacle keying feature in multiple pre-defined angular orientations relative to the housing.

2. The guide hardware of claim 1, wherein the receptacle keying feature is at least one protrusion that extends at least partially into the central opening of the keyway ring, each protrusion being received within a corresponding groove along a length of the pin of the guide plug as the pin is received in the channel when the receptacle keying feature is key mated to the pin.

3. The guide hardware of claim 1, wherein the keyway ring has an octagonal outer perimeter and is selectively positionable within the channel to locate the receptacle keying feature in one of eight pre-defined angular orientations.

4. The guide hardware of claim 1, wherein the receptacle keying feature includes a first protrusion and a second protrusion that extend from the inner perimeter of the keyway ring at least partially into the central opening, the first protrusion having at least one of a different shape or a different size than the second protrusion.

5. The guide hardware of claim 1, wherein the keyway ring is selectively oriented in the channel such that the first side is more proximate to the mating end than the second side in a normal orientation, and the second side is more proximate to the mating end than the first side in an inverted orientation.

6. The guide hardware of claim 1, wherein the keyway ring is a first keyway ring, the first keyway ring being substitutable in the channel of the housing for a different, second keyway ring that has a different receptacle keying feature than the first keyway ring, the second keyway ring allowing the guide receptacle to key mate to a different pin than the pin of the guide plug that key mates to the first keyway ring.

7. The guide hardware of claim 1, wherein the guide receptacle includes a locking fastener coupled to the housing, the locking fastener being configured to removably engage the keyway ring to secure the keyway ring in a selected position and lock the angular orientation of the receptacle keying feature.

8. The guide hardware of claim 1, wherein the guide receptacle further includes a grounding band within the channel of the housing, the grounding band configured to simultaneously engage an interior surface of the housing and the pin of the guide plug within the channel to provide an electrical ground path between the guide receptacle and the guide plug.

9. The guide hardware of claim 1, wherein the keyway ring is configured to be held within a pocket of the housing, the pocket defining a section of the channel, the pocket being defined by pocket walls, the keyway ring having a series of perimeter surfaces along an outer perimeter of the keyway ring, wherein at least some of the perimeter surfaces of the keyway ring engage at least some of the pocket walls of the pocket in a selected position of the keyway ring to prohibit rotation of the keyway ring relative to the housing.

10. The guide hardware of claim 9, wherein the keyway ring is selectively positionable in the pocket in multiple angular orientations such that one perimeter surface of the keyway ring engages a first pocket wall of the pocket in a first selected position of the keyway ring and the same perimeter surface engages a different, second pocket wall of the pocket in a second selected position of the keyway ring.

11. A configurable guide hardware set for aligning a first connector mounted to a first circuit card with an associated second connector mounted to a second circuit card, the guide hardware set comprising:

a guide plug mounted to the first circuit card, the guide plug having a pin that includes a plug keying feature, the pin being selectively positionable to locate the plug keying feature in multiple pre-defined angular orientations relative to the first circuit card; and a guide receptacle mounted to the second circuit card, the guide receptacle including a housing that defines a channel therein, the guide receptacle further including a keyway ring and a grounding band that are held in the channel, the keyway ring defining a central opening therethrough that aligns with the channel, the keyway ring including a receptacle keying feature along an inner perimeter that defines the central opening, the keyway ring being selectively positionable to locate the receptacle keying feature in multiple pre-defined angular orientations relative to the housing;

wherein the pin of the guide plug is configured to be received in the channel of the guide receptacle through the central opening of the keyway ring when the plug keying feature is key mated with the receptacle keying feature, the grounding band configured to simultaneously engage an interior surface of the housing that defines the channel and the pin of the guide plug when the pin is within the channel to provide an electrical ground path between the guide receptacle and the guide plug.

12. The guide hardware set of claim 11, wherein the guide plug further includes a base that is mounted to the first circuit card, the base defining a slot therethrough, the pin extending through the slot of the base, the pin being selectively positionable within the slot to locate the plug keying feature in the multiple pre-defined angular orientations.

13. The guide hardware set of claim 12, wherein the base includes a series of guide walls that define at least a portion of the slot, the pin including a flange extending around a perimeter of the pin, the flange having a series of perimeter surfaces, wherein at least some of the perimeter surfaces of the flange engage at least some of the guide walls of the base in a selected position of the pin to prohibit rotation of the pin relative to the base.

14. The guide hardware set of claim 11, wherein the pin includes a flange that extends around a perimeter of the pin, the flange having a series of perimeter surfaces, the flange being received in an aperture of the first circuit card, at least some of the perimeter surfaces of the flange engaging corresponding card walls that define the aperture when the pin is in a selected position to prohibit rotation of the pin relative to the first circuit card.

15. The guide hardware set of claim 11, wherein the receptacle keying feature is at least one protrusion that extends from the inner perimeter of the keyway ring at least partially into the central opening, the plug keying feature being at least one groove extending along a length of the pin, each protrusion of the keyway ring being received in a corresponding groove of the pin as the pin is received in the channel when the receptacle keying feature is key mated to the plug keying feature.

16. The guide hardware set of claim 15, wherein the receptacle keying feature is key mated to the plug keying feature when both:

the at least one groove of the plug keying feature is sized and shaped to receive the corresponding at least one protrusion of the receptacle keying feature, and the selected angular orientation of the receptacle keying feature is aligned with the selected angular orientation of the plug keying feature.

17. The guide hardware set of claim 11, wherein the receptacle keying feature is at least one groove extending along a length of the inner perimeter of the keyway ring, the plug keying feature being at least one protrusion extending radially outward from the pin, each protrusion of the pin being received in a corresponding groove of the keyway ring as the pin is received in the channel when the receptacle keying feature is key mated to the plug keying feature.

18. The guide hardware set of claim 11, wherein the receptacle keying feature includes a first protrusion and a second protrusion that extend from the inner perimeter of the keyway ring at least partially into the central opening, the first protrusion having at least one of a different shape or a different size than the second protrusion, wherein the plug keying feature includes a first groove and a second groove along the pin that are configured to accommodate the first protrusion and the second protrusion, respectively, wherein the first groove does not accommodate the second protrusion.

19. The guide hardware set of claim 11, wherein the housing extends between a mating end and an opposite end, the channel being open at the mating end and extending towards the opposite end, the grounding band held in the channel axially between the keyway ring and the opposite end of the housing.

20. The guide hardware set of claim 11, wherein the grounding band defines a cavity that is configured to receive the pin of the guide plug therethrough, the grounding band including a plurality of ribs that bow radially inwards into the cavity to engage the pin.

* * * * *